US006560837B1

(12) United States Patent
Hodjat et al.

(10) Patent No.: US 6,560,837 B1
(45) Date of Patent: May 13, 2003

(54) ASSEMBLY DEVICE FOR SHAFT DAMPER

(75) Inventors: Yahya Hodjat, Oxford, MI (US); Lin Zhu, Rochester Hills, MI (US); Leslie Cole, London (CA)

(73) Assignee: The Gates Corporation, Denver, CO (US)

( * ) Notice: Subject to any disclaimer, the term of this patent is extended or adjusted under 35 U.S.C. 154(b) by 0 days.

(21) Appl. No.: 10/210,297

(22) Filed: Jul. 31, 2002

(51) Int. Cl.[7] ..... B25B 27/14

(52) U.S. Cl. ..... 29/280; 29/235; 29/282; 29/451

(58) Field of Search ..... 29/280, 229, 235, 29/255, 263, 282

(56) References Cited

U.S. PATENT DOCUMENTS

| | | | | | |
|---|---|---|---|---|---|
| 2,660,780 | A | * | 12/1953 | Beck | 29/235 |
| 3,553,817 | A | | 1/1971 | Lallak | |
| 3,605,238 | A | * | 9/1971 | Escholz | 29/208 C |
| 3,639,972 | A | | 2/1972 | Schelin et al. | |
| 4,028,797 | A | * | 6/1977 | Miller | 29/451 |
| 4,138,778 | A | * | 2/1979 | Marzole | 29/235 |
| 4,141,129 | A | * | 2/1979 | Martini | 29/235 |
| 5,050,282 | A | | 9/1991 | Zannini | |
| 5,138,752 | A | | 8/1992 | Tasner | |
| 5,909,909 | A | | 6/1999 | Glauber | |
| 6,209,183 | B1 | | 4/2001 | Bugosh | |

* cited by examiner

*Primary Examiner*—Joseph J. Hail, III
*Assistant Examiner*—Daniel Shanley
(74) *Attorney, Agent, or Firm*—J. A. Thurnau, Esq.; C. H. Castleman, Esq.; S. G. Austin, Esq.

(57) ABSTRACT

An assembly device for a shaft damper. The assembly device comprises a holding member for holding a damper. The holding member is releasably engaged with a pair of parallel elongate members. An actuator is connected to the elongate members and to a piston. A shaft damper is inserted into and temporarily held by the holding member. The holding member containing the shaft damper is inserted into a shaft a predetermined distance. The actuator then slidingly retracts the holding member while a pressing member at an end of the piston simultaneously holds the damper in the proper position in the shaft.

7 Claims, 4 Drawing Sheets

ASSEMBLY DEVICE FOR SHAFT DAMPER

FIELD OF THE INVENTION

The invention relates to an assembly device for a shaft damper, and more particularly, to an assembly device for installing a shaft damper in a predetermined position in a shaft bore.

BACKGROUND OF THE INVENTION

Rotating shafts generally oscillate in various modes depending on the type of service. Shaft vibrations contribute to noise. Dampers are known which damp shaft vibrations. The dampers reduce operating noise as well as premature wear of the shaft and failure of the shaft by fatigue.

Dampers may take the form of a flexible liner in a drive shaft. They also may comprise a bending or torsional damper comprising an inertial mass within an annular chamber fixed to a shaft outer surface.

Means are available to install flexible or compressible parts into a bore, such as an o-ring or bushing insertion tool.

Representative of the art is U.S. Pat. No. 3,553,817 (1968) to Lallak et al. which discloses an o-ring installing tool comprising a mandrel having a generally W-shaped groove at one end and a retaining sleeve slideable along the mandrel.

Also representative of the art is U.S. Pat. No. 6,209,183 B1 (2001) to Bugosh which discloses a tool for installing a radially compressible bushing into a housing of a rack and pinion steering system.

Reference is also made to co-pending U.S. application Ser. No. 10/057,028 filed Jan. 23, 2002 which discloses a shaft damper of the type disclosed herein.

What is needed is an assembly device for installing a shaft damper in a predetermined position in a shaft bore. The present invention meets this need.

SUMMARY OF THE INVENTION

The primary aspect of the invention is to provide an assembly device for installing a shaft damper in a predetermined position in a shaft bore.

Other aspects of the invention will be pointed out or made obvious by the following description of the invention and the accompanying drawings.

The invention comprises an assembly device for a shaft damper. The assembly device comprises a holding member for holding a damper. The holding member is releasably engaged with a pair of parallel elongate members. An actuator is connected to the elongate members and to a piston. A shaft damper is inserted into and temporarily held by the holding member. The holding member containing the shaft damper is inserted into a shaft a predetermined distance. The actuator then slidingly retracts the holding member while a pressing member at an end of the piston simultaneously holds the damper in the proper position in the shaft.

DETAILED DESCRIPTION OF THE INVENTION

Figure 1:
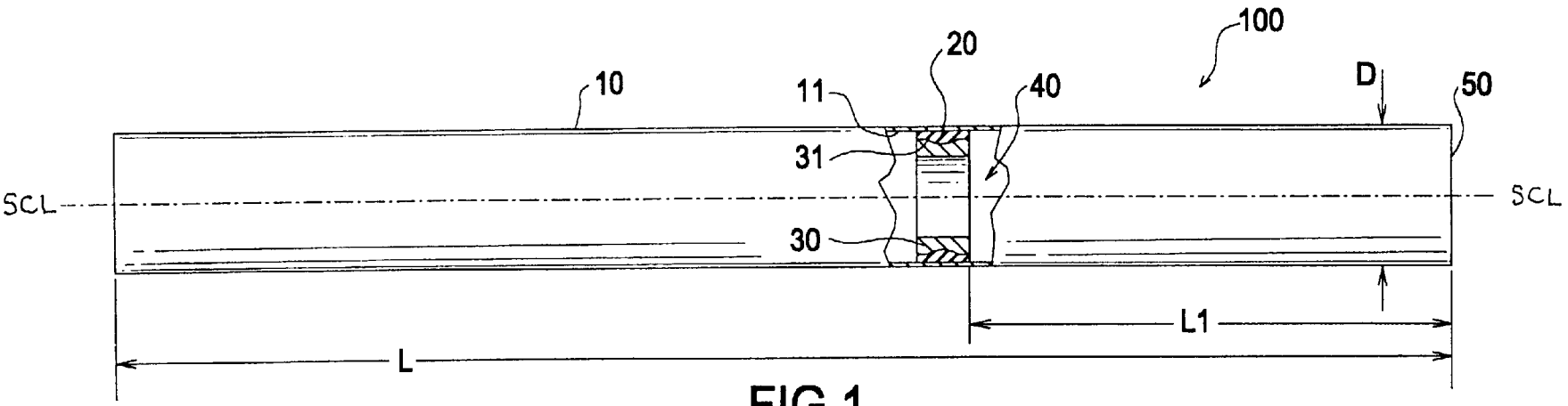
FIG. 1 is a cross-sectional side view of a shaft damper.

FIG. 1 is a cross-sectional side view of a shaft damper. Shaft damper 100 comprises elastomeric member 20 and inertial member 30 which are engaged with shaft 10 in bore 40. Shaft 10 having a length L and a diameter D and a shape. Shaft 10 as further described herein is circular, but may also describe other cross-sectional shapes including for example, oval, rectangular, triangular or any other geometric shape as may be required. The inventive assembly device can accommodate any such geometric shape as may be required to install a shaft damper.

Elastomeric member 20 and inertial member 30 are located at a predetermined distance L1 from an end 50 of shaft 10 in order to damp an oscillation of shaft 10.

Figure 2:
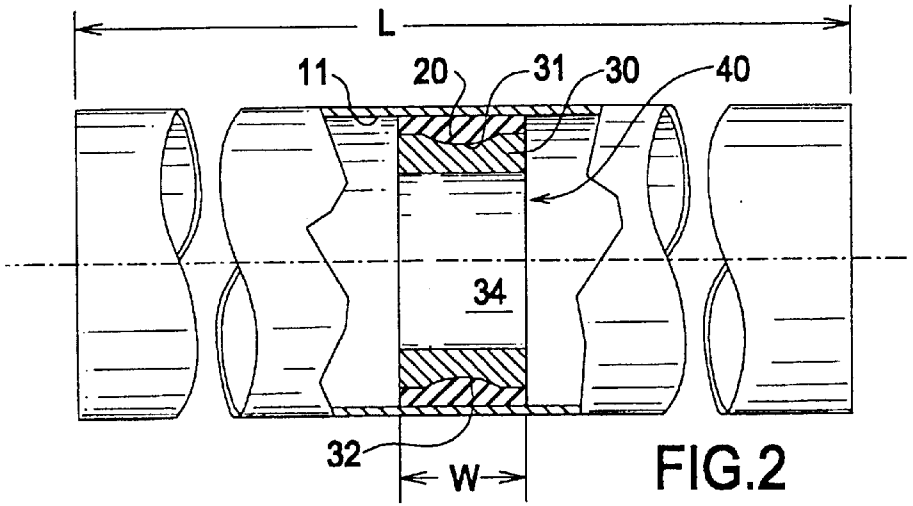
FIG. 2 is a detail of a shaft damper.

FIG. 2 is a detail of a shaft damper. Elastomeric member 20 is engaged between a shaft inner surface 11 and an inertial member outer surface 31. Inner surface 11 may comprise a predetermined surface roughness to enhance a surface coefficient of friction thereby enhancing an engagement between the elastomeric member 20 and the inner surface 11.

Elastomeric member 20 is compressed in a range of approximately 5% to 50% between the inner surface 11 and the outer surface 31 to assure proper retention of the elastomeric member 20 and inertial member 30 in a predetermined position. Inertial member 30 further comprises relief surface 32 in outer surface 31 which serves to further mechanically engage inertial member 30 to elastomeric member 20. Inertial member 30 may also describe a bore 34. Inertial member 30 may also be a solid disk without bore 34, depending upon a required mass for inertial member 30, which in turn affects a damping coefficient.

Surface 32 may comprise any suitable geometric shape as may be required to mechanically fix a position of the inertial member in shaft bore 40. The arcuate shape for surface 32 is depicted in FIG. 2 by way of example and not of limitation. A surface roughness to increase a coefficient of friction may also be applied to surface 32 to enhance engagement between the elastomeric member 20 and inertial member 30, to thereby fix a predetermined position of inertial member in bore 40.

Elastomeric member 20 comprises a resilient material that may comprise any natural rubber, synthetic rubber, any combinations or equivalents thereof, or any other resilient material that is capable of withstanding a shaft operating temperature and thermal and mechanical operating cycles. For example, but not by way of limitation, these may include EPDM (ethylene-propylene diene rubber), HNBR (hydrogenated acrylonitrile-butadiene rubber), PU (polyurethane), CR (chloroprene rubber), SBR (styrene-butadiene rubber), NBR (nitrile rubber), plus any equivalents or combinations of two or more of the foregoing.

Figure 3:
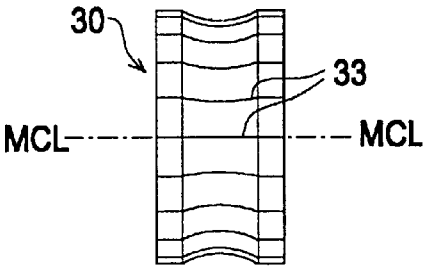
FIG. 3 is a detail of a grooved inertial member surface.

FIG. 3 is a detail of a grooved inertial member surface. In this embodiment, inertial mass 30 comprises a profile having grooves 33 extending parallel to a shaft centerline SCL, or extending parallel to an inertial mass centerline MCL. Grooves 33 create a mechanical locking between the inertial mass 30 and the elastomeric member 20 in a radial direction, thereby enhancing engagement of the damper within shaft 10.

Figure 4:
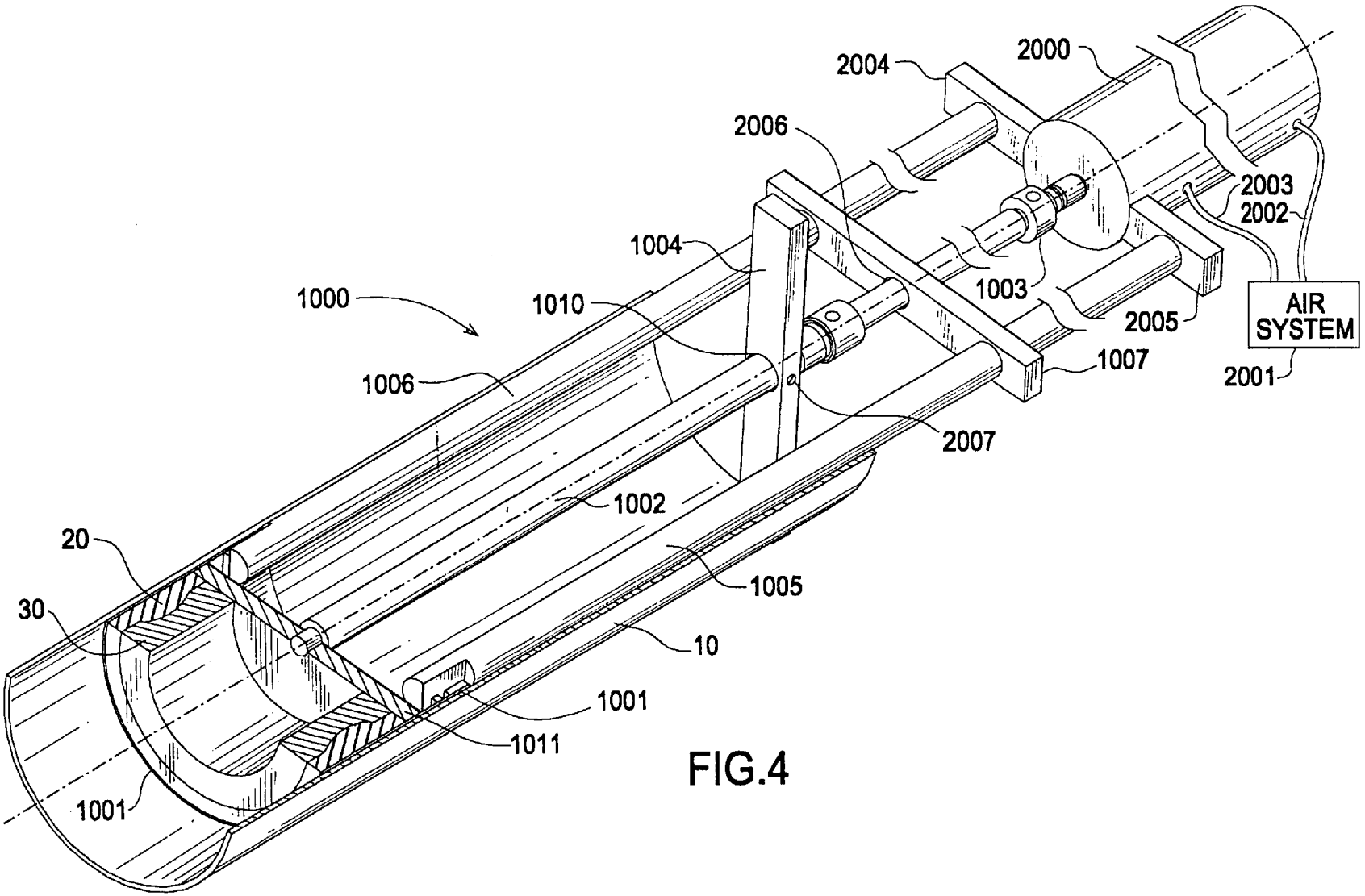
FIG. 4 is a perspective view of the assembly device for a shaft damper.

FIG. 4 is a perspective view of the assembly device for a shaft damper. Assembly device 1000 comprises a damper holding member 1001 and piston 1002. Elongate members or rods 1005, 1006 are each attached to base plate 1007 and members 2005, 2004 respectively. Piston 1002 extends parallel to rods 1005, 1006 through hole 2006 in base plate 1007.

Actuating cylinder 2000 is connected to an end of piston rod 1003, which is connected to piston 1002. Actuating cylinder 2000 is a motive member and may comprise a pressurizable cylinder such as a hydraulic or pressurized air cylinder, or an electrically actuated screw or equivalents or combinations thereof. The instant invention may also be operated by hand by an operator by pulling on plate 1007 while simultaneously pushing on piston 1002.

In the preferred embodiment cylinder 2000 comprises an air cylinder connected by hoses 2002, 2003 to an air system 2001. Pneumatic air systems are known in the art.

Stop 1004 is attached to a predetermined position on piston 1002 by a set screw 2007 or other suitable means of attachment. Stop 1004 extends across a width of shaft 10 in order to limit an insertion length L1, see FIG. 1, of the piston 1002, and thereby establish a position of the assembly device, and thereby a position of the shaft damper, in shaft 10.

Pressing member 1011 is connected to an end of piston 1002. Pressing member urges the damper elastomeric member 20 and inertial member 30 out of the holding member 1001 as the holding member is withdrawn during installation of the shaft damper into shaft 10. Pressing member 1011 has a diameter less than an internal diameter of holding member 1001.

Figure 5:
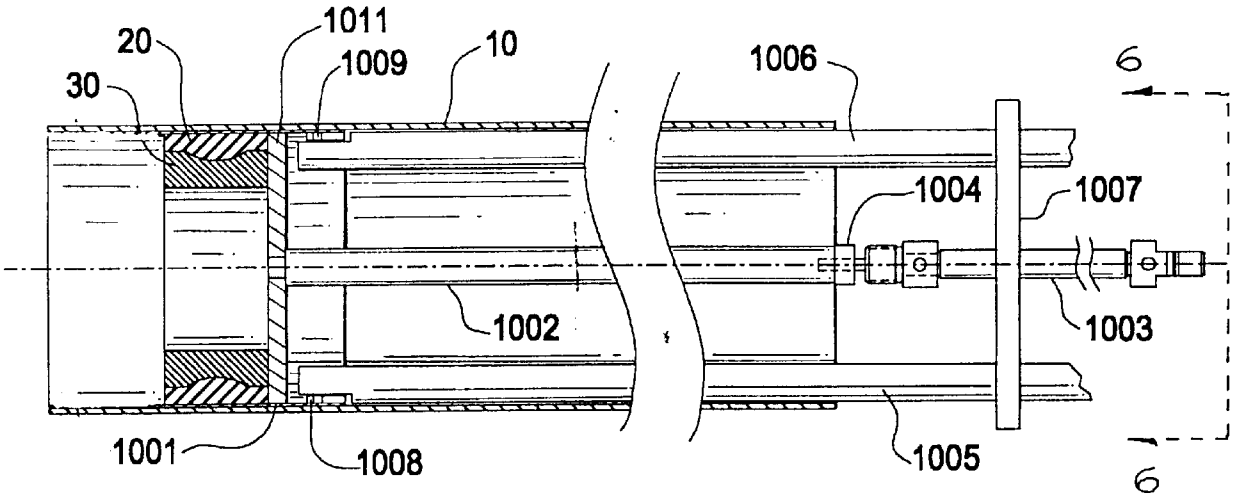
FIG. 5 is a cross-sectional view of the assembly device for a shaft damper.

FIG. 5 is a cross-sectional view of the assembly device for a shaft damper. An end of rod 1005 comprises pin 1008 extending radially outward. An end of rod 1006 comprises pin 1009 extending radially outward. Pins 1008, 1009 each engage a slot in damper holding member 1001, see FIG. 7. Holding member 1001 has a concentric, sliding fit within shaft bore 40.

Figure 6:
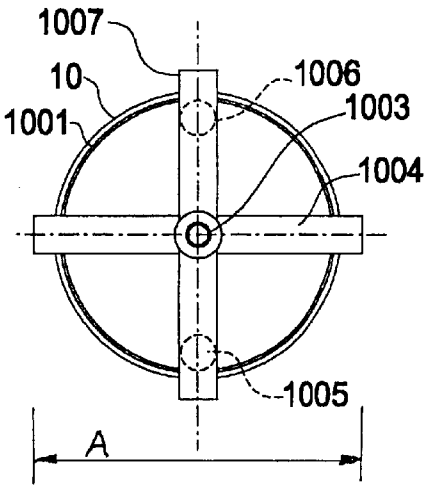
FIG. 6 is an end view of the assembly device for a shaft damper.

FIG. 6 is an end view of the assembly device for a shaft damper. Rods 1005, 1006 extend parallel to piston 1002. Stop 1004 has a width (A) exceeding a width of shaft 10.

Figure 7:
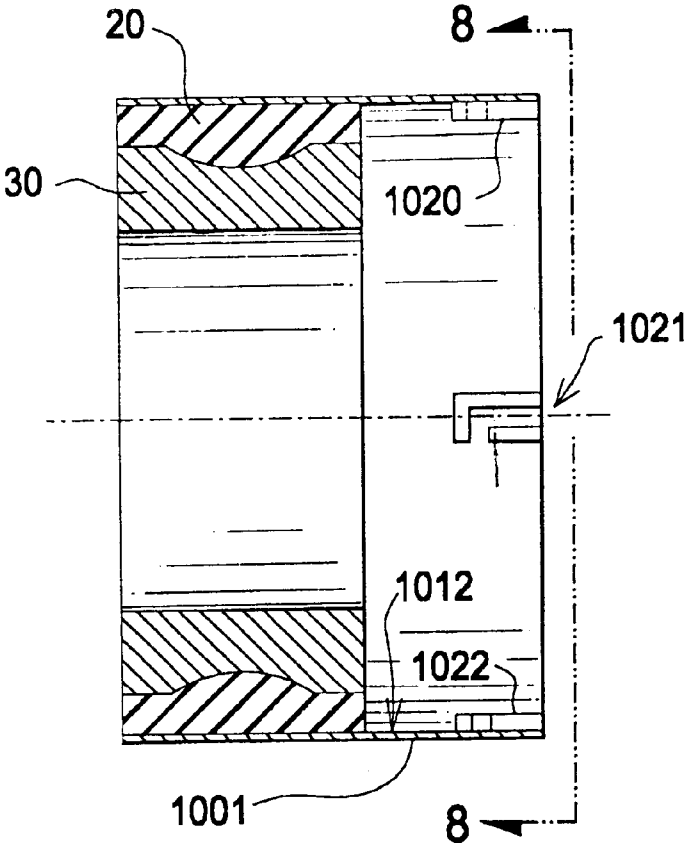
FIG. 7 is a cross-sectional view of a damper holding member.

FIG. 7 is a cross-sectional view of a damper holding member. Member 1001 is manufactured with an outside diameter equivalent to the lowest tolerance for an internal diameter of a shaft 10 in order to allow it to have a concentric, sliding fit in shaft bore 40. It is somewhat longer in length than elastomer 20 to accommodate a connection with rods 1005, 1006.

Connection members 1020, 1021 and 1022 are each disposed upon an inner surface of holding member 1001. Each connection member describes an "L" shaped slot or receiving member, 1020*a*, 1021*a*, 1022*a*, for receiving an engaging member or pin 1008 or 1009 as described in FIG. 5. Four connecting members disposed about holding member 1001 allows for increased flexibility for releasably connecting to rods 1005, 1006. One can appreciate that only two connecting members need be used at any one time. Any number of connecting members may be used in holding member 1001, so long as they are present in pairs since there are two rods 1005, 1006. The holding member 1001 is releasably connected to rods 1005, 1006 by applying a partial turn to the holding member to fully engage the pins 1008, 1009 in each respective connecting member slot, for example, 1020*a* and 1022*a*.

In use, the holding member 1001 is first releasably connected to rods 1005, 1006 using members 1020, 1021 engaged with pins 1008, 1009. Elastomeric member 20 and inertial mass 30 are then pressed into the holding member 1001 as shown in FIG. 4. Internal surface 1012 of the holding member is polished for ease of inserting and removing elastomeric member 20. A dry lubricant known in the art, for example graphite but not limited thereto, may be used to facilitate insertion of the elastomer into the holding member. Preferably the lubricant is not reactive with the material comprising the elastomeric member 20 or shaft 10.

The elastomeric member and inertial member are inserted into the holding member until they are substantially flush with a holding member end as shown in FIG. 7. The compression of the elastomeric member in the holding member is somewhat greater than the compression of the elastomer after it is installed in the shaft. For example, for 25% elastomeric member compression in a shaft, the elastomeric member compression in the holding member is approximately 35% to 40%.

As described previously, connecting holding member 1001 to elongate members or rods 1005 and 1006 simply requires that the holding member connection members 1020, 1021, 1022 be engaged with pins 1008, 1009. Pins 1008, 1009 are inserted respectively into the slots 1020*a* or 1021*a* or 1022*a* as required.

The assembly device with the holding member connected is then inserted into shaft 10 by insertion of the rods 1005, 1006 and piston 1002. Insertion of the holding member 1001, rods and piston proceeds until stop 1004 engages the end of shaft 10. Stop 1004 is positioned on piston 1002 relative to holding member 1001 in order to result in the holding member and thereby the damper being placed in the proper installation position within the shaft 10, for example, at position having a distance L1 from end 50 as shown in FIG. 1. Set screw 2007 locks stop 1004 in place on piston 1002.

Once the holding member, and thereby the damper, is properly placed, actuating cylinder 2000 retracts rods 1005, 1006 and thereby retracting holding member 1001. Holding member 1001 is axially moved to extract it from bore 40 while pressing member 1011 remains stationary by operation of cylinder 2000. Therefore, pressing member 1011 holds the damper in place as the holding member 1001 is slidingly disengaged from the damper elastomeric member 20 and thereby extracted from bore 40. As the holding member is extracted from shaft 10, elastomeric member 20 expands against the interior surface of shaft 10 to complete installation of the damper. The assembly device can then be removed from the shaft and the process repeated for the next damper installation.

The inventive tool allows the damper to be installed in a shaft in a precise location without sliding or rubbing the elastomeric member 20 against the interior surface of the shaft as it is inserted to the desired location in the bore. Movement of the elastomeric member against a rough shaft interior would have a detrimental effect on the elastomeric member, adversely affecting the ability of the elastomeric member to engage the shaft, as well as potentially modifying the damping capability of the damper. The inventive tool also allows a shaft damper to be installed without applying a lubricant to the bore of a shaft.

Figure 8:
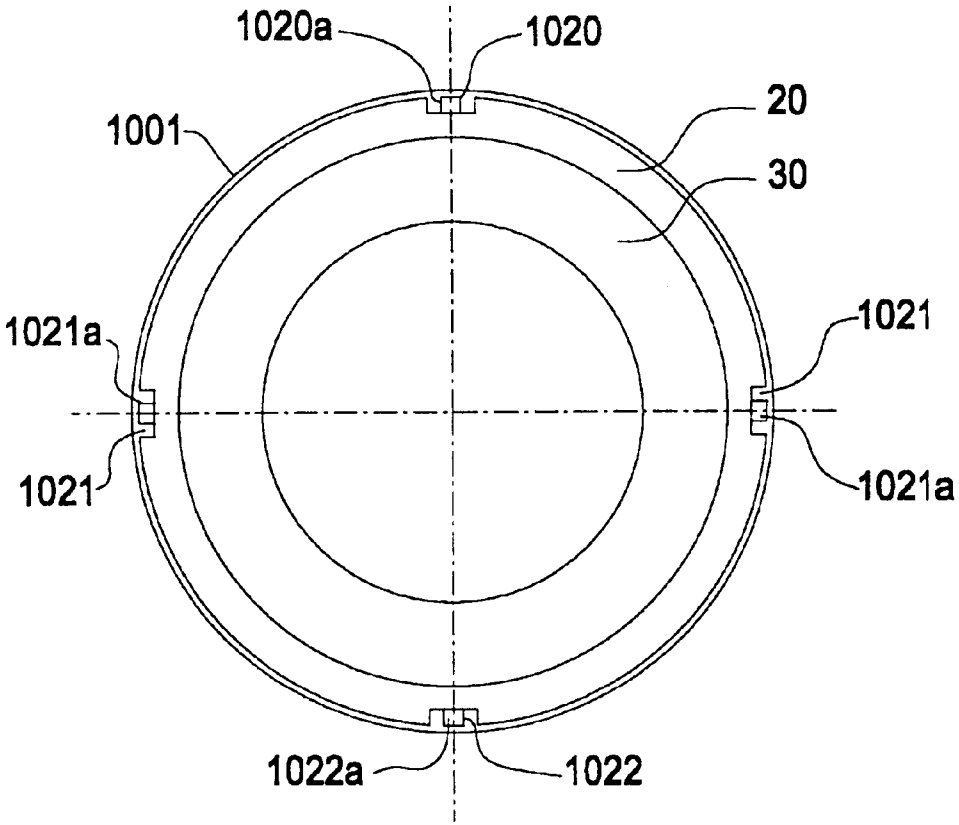
FIG. 8 is an end view of a damper holding member at line 8—8 in FIG. 7.

FIG. 8 is an end view of a damper holding member at line 8—8 in FIG. 7. Connection members 1020, 1021 and 1022 are shown in holding member 1001. Slots 1020*a*, 1021*a*, and 1022*a* are also shown for receiving pins 1008, 1009.

Although a form of the invention has been described herein, it will be obvious to those skilled in the art that variations may be made in the construction and relation of parts without departing from the spirit and scope of the invention described herein.

We claim:

1. An assembly device comprising:

a holding member for holding a resilient member;

the holding member removeably insertable into a shaft to receive the resilient member;

an elongate member releasably connectable to the holding member;

a motive member having a pressing member, the motive member engaged with the elongate member whereby the elongate member is axially moveable relative to the pressing member; and the pressing member engageable with the resilient member whereby the resilient member is urged from the holding member to a position in the shaft by an axial movement of the elongate member.

2. The assembly device as in claim 1, wherein the holding member further comprises a smooth surface to slideably engage the resilient member.

3. The assembly device as in claim 1, wherein:

the holding member comprises a receiving member for releasably connecting to the elongate member.

4. The assembly device as in claim 1, wherein the motive member comprises a pressurizable cylinder.

5. The assembly device as in claim 1, wherein the pressing member describes a shape substantially conforming to a holding member shape.

6. The assembly device as in claim 1 further comprising a stop member for disposing the holding member at a predetermined position in the shaft.

7. The assembly device as in claim 1, wherein the holding member describes a shape substantially conforming to a shaft bore shape.

* * * * *